US006557214B2

(12) United States Patent
Pinto

(10) Patent No.: US 6,557,214 B2
(45) Date of Patent: May 6, 2003

(54) METHOD AND APPARATUS FORMING A FIBER WEB

(76) Inventor: Akiva Pinto, P.O. Box 1100-171, Gastonia, NC (US) 28053-1100

( * ) Notice: Subject to any disclaimer, the term of this patent is extended or adjusted under 35 U.S.C. 154(b) by 0 days.

(21) Appl. No.: 10/127,186

(22) Filed: Apr. 22, 2002

(65) Prior Publication Data

US 2002/0116792 A1 Aug. 29, 2002

Related U.S. Application Data

(63) Continuation-in-part of application No. 09/977,814, filed on Oct. 15, 2001, now Pat. No. 6,460,223, which is a continuation-in-part of application No. 09/852,514, filed on May 10, 2001, now Pat. No. 6,421,884, which is a continuation-in-part of application No. 09/760,925, filed on Jan. 16, 2001, now Pat. No. 6,276,028, which is a continuation-in-part of application No. 09/505,922, filed on Feb. 17, 2000, now Pat. No. 6,263,545.

(51) Int. Cl.[7] ..... D01G 15/02

(52) U.S. Cl. ..... 19/105; 19/97.5; 19/200; 19/205

(58) Field of Search ..... 19/105, 65 A, 19/98, 97.5, 106 R, 145.5, 145.7, 161.1, 200, 203, 204, 205, 296, 300, 302, 303, 304, 90, 92, 97, 225

(56) References Cited

U.S. PATENT DOCUMENTS

| | | | | | |
|---|---|---|---|---|---|
| 4,154,889 | A | * | 5/1979 | Platt | 156/148 |
| 4,403,374 | A | * | 9/1983 | Wood | 19/105 |
| 4,657,444 | A | * | 4/1987 | Pinto | 19/105 |
| 4,694,538 | A | * | 9/1987 | Pinto et al. | 19/105 |
| 5,003,670 | A | * | 4/1991 | Waeber et al. | 19/0.27 |
| 5,950,282 | A | * | 9/1999 | Pinto | 19/105 |
| 6,159,882 | A | | 12/2000 | Kean et al. | |
| 6,305,920 | B1 | | 10/2001 | Kean et al. | |

* cited by examiner

*Primary Examiner*—Gary L Welch

(57) ABSTRACT

The instant invention is directed to an arrangement for forming a stable fiber web having high loft and high resilience. The arrangement includes a cabinet receiving opened and blended fibers connected with a fiber web forming chute which receives the opened and blended fibers from the cabinet. The forming chute includes a first and second wall and fiber contacting elements which assist in urging the fibers through and out an exit of the chute in an evenly distributed condition while forming the fiber web. The fiber contacting elements include a fiber inter-engaging device associated with at least one of the first and second walls, said inter-engaging device acting said outer fibers causing these fibers to inter-engage creating a stable outer surface over the fiber web.

20 Claims, 3 Drawing Sheets

METHOD AND APPARATUS FORMING A FIBER WEB

This is a continuation-in-part of my earlier filed application Ser. No. 09/977,814, filed on Oct. 15, 2001 now U.S. Pat. No. 6,460,223, which is a continuation-in-part of Ser. No. 09/852,514, filed on May 10, 2001, now U.S. Pat. No. 6,421,884, which is a continuation-in-part of Ser. No. 09/760,925, filed on Jan. 16, 2001, now U.S. Pat. No. 6,276,028, which is a continuation-in-part of Ser. No. 09/505,922, filed on Feb. 17, 2000, now U.S. Pat. No. 6,263,545.

BACKGROUND OF THE INVENTION

SUMMARY OF THE INVENTION

The instant arrangement is for forming a stable fiber web having high loft and high resilience. The arrangement includes a cabinet receiving opened and blended fibers and a fiber web forming chute which receives the opened and blended fibers from the cabinet. The forming chute including a first and second wall with fiber contacting elements which engage the fibers and assist in urging them through the fiber forming chute and out its exit in an evenly distributed condition forming a fiber web. The fiber contacting elements include a fiber inter-engaging device associated with at least one of the first and second walls. The inter-engaging device acts on at least the outer fibers adjacent to at least one of the first and second walls to cause these fibers to inter-engage creating a stable outer surface on the fiber web being formed. A fiber web so constructed will better maintain its formed configuration during transport to further processing.

The fiber inter-engaging device may comprise a heating element which when contacting the outer fibers causes adjacent ones to fuse together. The heating element may comprise a heating roll having raised fiber engaging lines arranged in a patter over its outer surface. There may be a pair of these heating rolls located adjacent the exit in opposing relationship.

The fiber inter-engaging device is formed as at least a portion of the first and second walls.

The fiber inter-engaging device may comprise a needle bed or a pair of opposed needle beds which operate within the chute along at least one of the first and second walls.

The arrangement may include an air distribution system which delivers an air flow into the fiber forming chute for assisting in the distribution and movement of the fibers within the forming chute. A distributor may be associated with the air distribution system which is operative to add chemicals to the air flow for distribution throughout the fibers during formation of the fiber web.

Alternatively, the arrangement may include a distributor for adding the chemicals to a feed chute above the mixing chamber. In this arrangement, the beater roll acts to throw the fibers into the powdered chemicals being fed into the mixing chamber by a feed roll.

The arrangement may include a conveyor system adjacent the chute exit. The fiber inter-engaging device may be arranged to be adjacent one end of the conveyor system. The fiber inter-engaging system may comprise a heating member for heating at the outer fibers of the fiber web passing over the conveyor causing adjacent fibers to fuse. The heating member may comprise a pair of heating rolls.

The fiber contacting element may include a packing belt which forms at least a part of one of the first and second walls. Also, the fiber contacting element may include a vibrating plate forming at least a part of one of the first and second walls. There may be a compression roll adjacent the exit which is heated. The heated compressor roll acts to compress and to fuse the outer fibers of the fiber web.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
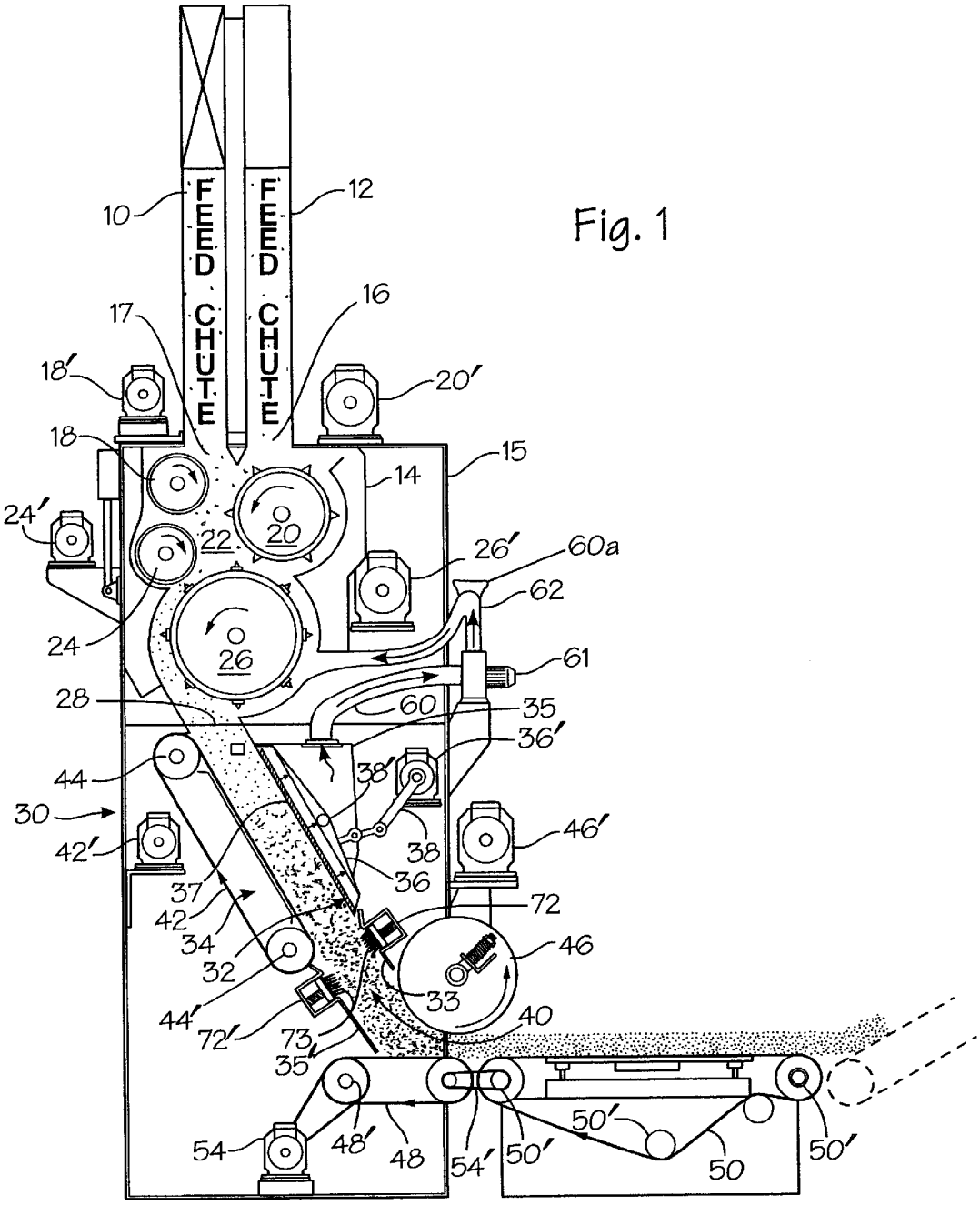
FIG. 1 is a cutaway side view of a first arrangement of the fiber web forming device.
Figure 2:
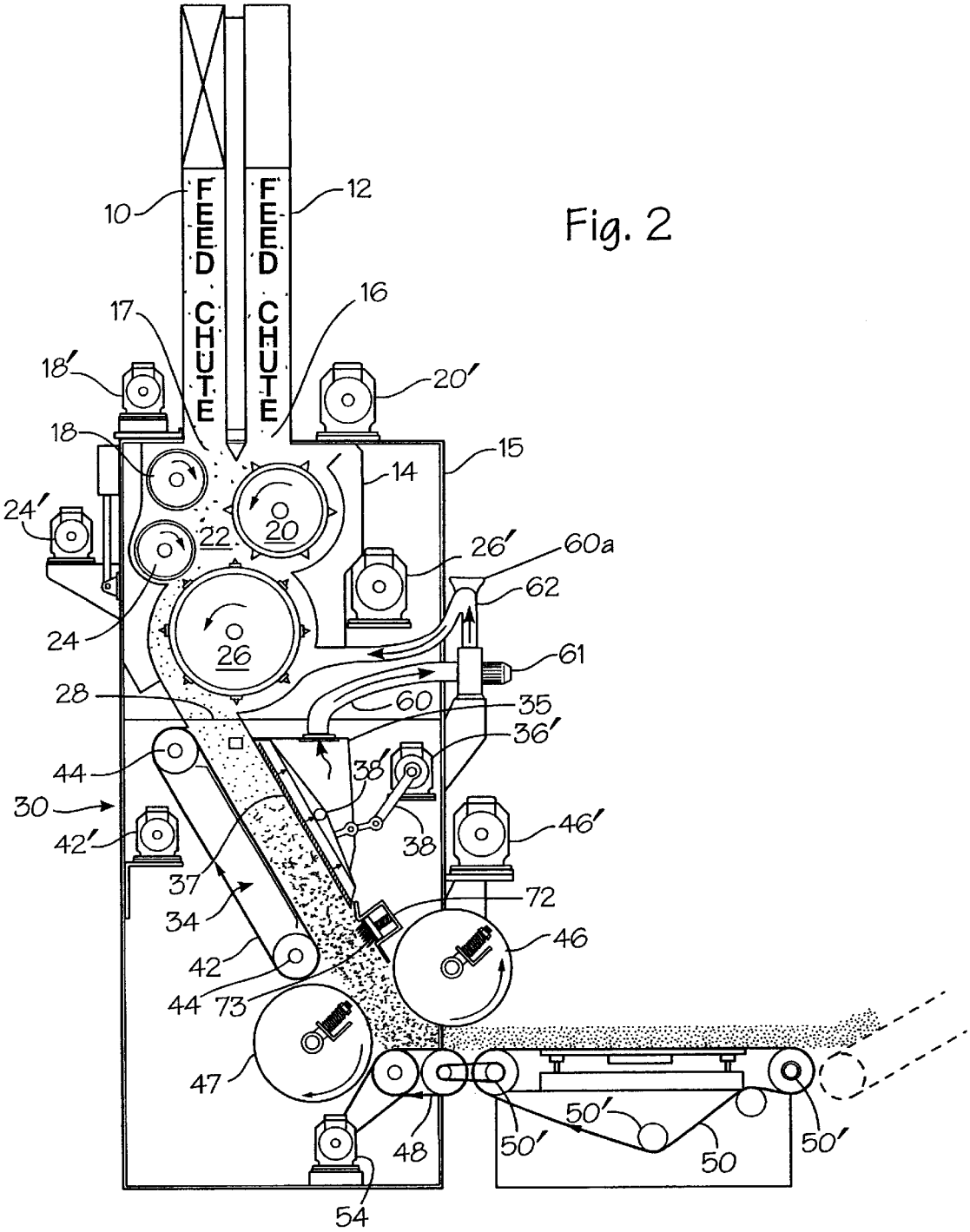
FIG. 2 is a cutaway side view of a second arrangement of the fiber web forming device.
Figures 3, 4:
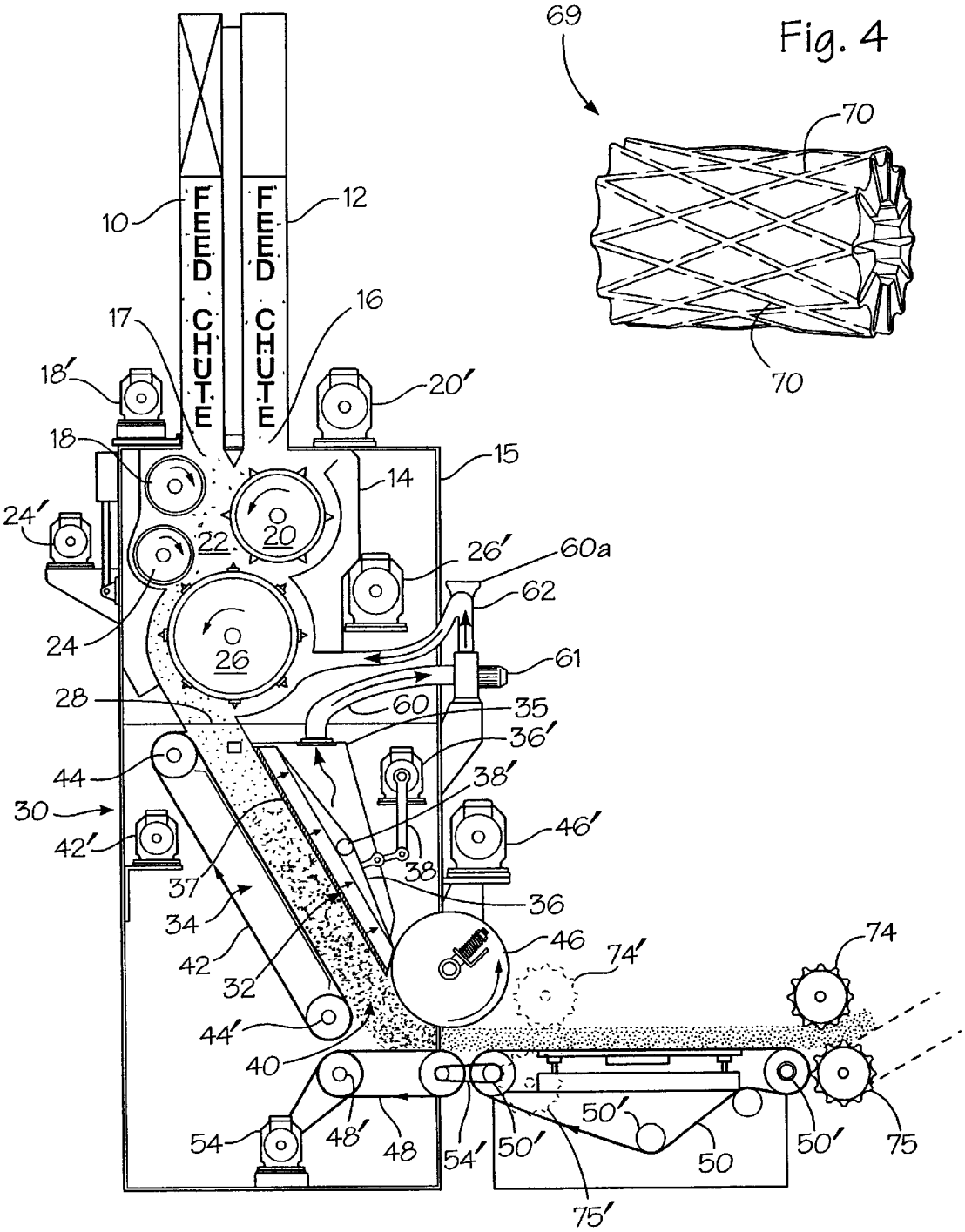
FIG. 3 is a cutaway side view of a third arrangement of the fiber web forming device.
FIG. 4 is an exploded view of the outer surface of a preferred heating roll.

Turning now to the drawings, in FIGS. 1–3 show apparatus for transforming fibers into a non-woven fiber web or fabric. The system begins with a fiber feed system substantially as disclosed in co-pending applications Ser. Nos. 09/760,925 and 09/505,922, now U.S. Pat. Nos. 6,276,028 and 6,263,545, which may include carding machines of any known type which may be arranged side by side or in parallel. The fibers fed through each machine may be maintained separated during this phase of the operation. It is noted that other types of fiber opening apparatus, such as air lay openers, may be substituted for the carding machines.

Doffers, such as roll doffers or air doffers, are connected with doffing machines to withdraw the carded fibers from the carding roll and deposit them onto a transport. It is noted that it is preferred both doffers be of the same type, however, this is not necessary.

The transports deliver the carded and doffed fibers into a reserve supply which acts to further blend the fibers and also to provide a constant supply of fibers for the next phase of the operation. Transports deliver the fibers from the reserve supplies to respective of feed chutes 10, 12 in the manner described in the afore referred to parent applications.

The transports may be in the form of conveyor belts or they may be in the form of air ducts. Fans may be provided to generate the air current to carry the fibers through the transports.

Feed chutes 10, 12, as shown in FIG. 1, are connected with housing 14 which is formed within a cabinet 15.

Fiber discharge openings 16, 17 are arranged in the upper surface of housing 14. Feed roll 18 is located adjacent opening 17 and rotates in a clockwise direction. Feed roll 20 is located adjacent opening 16 and rotates in a counter clockwise direction. Preferably, the diameter of feed roll 18, which is about 6 inches in diameter, is about half the diameter of feed roll 20.

Feed rolls 18 and 20 are driven by independent drive motors 18', 20' which are each controlled to selectively drive the feed rolls at selected RPM's. The speed selected is determined by sensors which usually control feed rolls 18 and 20 to have the same peripheral speed. A median peripheral speed for feed rolls 18 and 20 is between 0 and 20 m/min. In cases where the mixture of fibers from chutes 10 and 12 is to be unequal, the relative peripheral speed between rolls 18 and 20 is adjusted to obtain the desired mixture.

The feed rolls deliver the fibers into mixing chamber 22 where they are further opened and blended. At the lower end of mixing chamber 22 there is located a combing roll 24 and a beater roll 26. Combing roll 24 along with feed roll 20 acts to pick up fibers in the mixing chamber and wipe them onto the outer surface of beater roll 26. The beater roll in turn acts to further open and blend the fibers as they are moved through the mixing chamber during delivery into receiving end 28 of forming chute 30.

Comber roll 24 and beater roll 26 are driven by motors 24' and 26' at selected speeds. The selected speed chosen for each of rolls 18, 20, and 26 is determined by the fiber blend desired and by the fiber volume necessary to form the fiber batt or non-woven fabric at the desired density and weight in forming chute 30.

The peripheral surfaces of feed rolls 18, 20, of comber roll 24 and of beater roll 26 are formed of pin like members of usual construction. Normally, the pins are arranged in parallel transverse rows, however in the case of at least feed roll 20, it has been found to be desirable to arrange the pin rows in a helical pattern. Such a pattern of teeth acts to more evenly wipe the fibers onto beater roll 26.

Forming chute 30 is of usual rectangular shape with an upper wall 32 and a lower wall 34 spaced by a pair of equal sized sides. Upper wall 32 includes a housing 35, one side of which comprises vibrating plate 36. Vibrating plate 36 extends across the width of upper wall 32 and lengthwise of forming chute 30 from adjacent the upper end of wall 32 to adjacent upper end portion 33 at the lower end of forming chute 30. Upper end portion 33 forms the upper surface adjacent discharge or delivery end 40 of the batt forming chute. Vibrating plate 36 is driven in a rocking motion about pivot 38' by motor 36' through linkage 38. The structure of chute 30 is maintained by vibrating plate 36 remaining a relatively constant position relative to lower wall 34.

Hood 35 has connected with a side wall remote chute 30 a conduit 60 which connects with blower or fan 61. A second conduit 62 connects blower 61 with housing 14 and mixing chamber 22. Lower surface 37 of vibrating plate 36 is perforated as indicated by the arrows. This structure allows blower 61 to force air in the direction of the arrows creating the following scenario.

An air flow may be forced through conduit 62 into mixing chamber 22. The velocity of the air flow is lower than the velocity of beater roll 26 and plays no significant roll in moving the blended and opened fibers through receiving end 28 of chute 30. As the air flow moves through chute 30 it acts to move or urge the fibers toward the upper side of chute 30 which assist in more evenly distributing the fibers preventing compacting toward the lower area of the web adjacent chute wall 34 by the movement of packing belt 42. The air flow further helps to maintain the fibers oriented in all directions which provides for greater stability for the fiber web.

As the air flow moves down chute 30 it is drawn through the openings in upper wall 32 and vibrating plate 36 and into hood 35. From the housing the air is circulated back to blower 61 through conduit 60 where the cycle is repeated.

The velocity of the air flow is preferably lower than the fiber velocity created by beater 26 with preferred velocity lower than 1 meter/second and the pressure of the air flow is between 1–50 millimeters water gauge.

Lower wall 34 carries packing belt 42 which covers substantially its entire area terminating just short of delivery end 40 adjacent lower end portion 35'. Packing belt 42 which is continuous, passes around roller 44 which is arranged near the upper end of lower wall 34 and around the roller 44' which is arranged adjacent lower end portion 35' near delivery end 40 of the batt forming chute. Motor 42' drives roller 44 and packing belt 42 in a clockwise direction. The packing belt acts along with the just described air flow to physically assist the movement of the fibers from receiving end 28 down the forming chute forming the fiber web or non-woven fabric fibers. The air flow may, if desired, also act to physically treat the fibers as earlier described. The fiber orientations are more evenly maintained throughout the batt forming chute. Also, the fiber density throughout the fiber web is more evenly maintained between the bottom and top surfaces of the fiber web.

A first arrangement of the improvement to the fiber web forming system thus far described includes a needle bed 72, 72' carried by upper and lower end portions 33 and 35' adjacent to delivery end 40. Each needle bed 72, 72' is of usual construction and is formed to extend across the entire width of forming chute 30. Each needle bed 72, 72' includes needles 73 which are driven in the usual reciprocating manner to pass through upper and lower end portions and into portions of the forming chute 30. The needle beds act as fiber inter-engaging devices as inter action of needles 73 with the fibers of the fiber web adjacent the upper and lower walls causes these fibers to inter-engage or entangle forming more stable upper and lower outer surfaces of the fiber web passing out delivery end 40. These more stable outer surfaces create a more stable fiber web. It is noted that in certain circumstances only one needle bed may be employed.

Compression roll 46, which is driven by motor 46', acts to compress and draw the formed fiber batt out of delivery end 40 of the batt forming chute.

It is the combined operations of vibrating plate 36 and packing belt 42 which draw and urge sufficient quantities of fibers toward delivery end 40. The fiber volume can be controlled by the speed of the vibrator plate, the air velocity, and the speed of the packing belt. Compressor roll 40 acts on the formed fiber web to compact it to a desired height providing a non-woven fabric or fiber web with desired entanglement, body, weight, and height.

A conveyor belt 48, arranged adjacent delivery end 40 receives the fiber web emerging from the delivery end. Conveyor belt 48, which passes around rollers 48', acts as a back wall against the force exerted by compression roll 46 and further acts as a delivery belt for moving the formed fiber web onto conveyor belt 50.

Conveyor belt 50 passes about rollers 50'. Motor 54 which is connected with a roller 48' also drives conveyor belt 50 through drive belt 54'.

Mounted intermediate rollers 50' is a scale which acts to weigh the fiber batt emerging from delivery end 40 as it is moved over conveyor belt 50. The weight of the formed fiber web or non-woven fabric is sent to a control which calculates its density and compares this density to a norm. The operation of compressor roll 46, conveyor belts 48, along with the scale and control are fully described in co-pending application with Ser. No. 09/505,922, now U.S. Pat. No. 6,263,545.

Turning now to FIG. 2, a second arrangement is shown for forming the stable fiber web with a more stable outer surface.

In this arrangement the fibers are moved into and through mixing chamber 22 and are fed into and through the fiber forming chute 30 as before described. The lower wall of the fiber forming chute comprises a packing belt 42 which extends from receiving end 28 to delivery end 40. Upper wall 37 comprises vibrator plate 36 which also extends from receiving end 28 to delivery end 40.

In this arrangement, adjacent the delivery end is arranged a pair of compression rolls 46, which receive the formed fiber web and compress it into a desired height. Again the speed of compression rolls 46 is controlled by motor 46'.

Arranged on the lower end of vibrator plate 36 is a fiber inter-engaging device in the form of needle bed 72 which includes needles 73 which penetrate into the upper area of fiber forming chute 30 to engage and entangle the upper outer fibers of the fiber web passing out delivery end 40.

The formed fiber web stabilized through the inter-engagement of the outer fibers is carried away by belts 48 and 50 as earlier described.

An alternative to this arrangement could be to provide that lower compression roll 46 be a heated roll. As such, compression roll 46 would function as a fiber inter-engaging device as the outer fibers of the lower fiber web surface could be inter-engaged by bonding with adjacent ones. This bonding could be brought about by utilizing at least some of the fibers as synthetic fibers with low melt characteristics. An alternative would be to introduce bonding materials through distributor 60*a* and conduit 60 to be inter-dispersed among the fibers forming the fiber batt. The outer fibers adjacent the lower surface would then be inter-engaged.

The arrangement shown in FIG. 2 could be constructed to provide that both compressor rolls 46 are heated rolls. This arrangement would provide that both rolls function as a fiber inter-engaging device as the fibers adjacent the upper fiber web surface would be inter-engaged by both entanglement, brought about by the needle bed, and bonding, brought about by heated roll 46.

Turning now to FIG. 3, the fiber batt forming system of the invention operates as previously described. As the formed fiber batt departs the delivery end and passes between compression roll 46 and belt 48 in route to belt 50. As the formed fiber web leaves belt 50 it is passed through heating rolls 74, 75 which function as a fiber inter-engaging device and interact with fibers adjacent the upper and lower outer surfaces of the fiber web. Again these fibers are inter-engaged by bonding.

Heating rolls 74, 75 could be moved to a position adjacent compression roll 46 as indicated at 74', 75'.

FIG. 4 shows a desired configuration for the heated rolls used with the disclosed fiber web forming apparatus. As shown, heating roll 69 is formed with raised or ribbed diagonally surfaces 70 which form a criss-cross pattern over its outer surface. The heat in the interior of the drum migrates into raised or ribbed surfaces.

In operation, heated rolls with these patterned surfaces form selected inter-engaged fiber areas over the outer surface of the fiber web.

It is to be understood that the particular rib configuration is optional. Also, that the surface of the heated roll is raised is optional.

It is noted that while the description has been limited to heating rolls, any other known type of heating unit could be used, i.e. infrared and resistor.

The arrangements described and shown in FIGS. 1, 2, and 3 are operative to produce lightweight fiber webs of no more than 100 grams per square meter or high weight fiber webs of up to 4000 grams per square meter having stabilized outer surfaces. The density between fiber webs is controlled by its height relative to its weight.

The arrangements described above are capable of receiving and providing a supply of carded, opened, and blended fibers to the fiber web or non-woven fabric forming machine at controlled rates and at controlled machine speed. The arrangement provides for an increased rate in production of non-woven webs of selected weights, densities, and heights. The fibers are more evenly blended and the fiber directions are oriented in all directions providing for a more stable, more sturdy, and more resilient product. Also, non-woven webs of up to seven meters wide are capable of being produced with the disclosed system.

The systems are ideal for preparing fibers which are all natural, all synthetic, or blends of natural and synthetic. Also, the fibers may be virgin fibers or regenerated fibers.

While preferred arrangements of the invention has been described using specific terms, such description is for illustrative purposes only, and it is to be understood that changes and variations may be made without departing from the spirit or scope of the following claims.

What is claimed is:

1. An arrangement for forming a stable fiber web having high loft and high resilience comprising:

a cabinet receiving opened and blended fibers;

a fiber web forming chute receiving said opened and blended fibers from said cabinet, said fiber web forming chute including a first and second wall and fiber contacting elements which engage said fibers and assist in urging said fibers through and out an exit of said chute in an evenly distributed condition forming said fiber web having at least upper and lower outer surfaces;

said arrangement further including a fiber inter-engaging device in position to engage with at least one of said upper and lower outer surfaces, said inter-engaging device acting on said fibers forming at least one of said upper and lower outer surfaces to cause said surface-forming fibers to further inter-engage creating at least one outer surface stable; whereby, said fiber web will better maintain its formed configuration during transport to further processing.

2. The arrangement of claim 1 wherein said fiber inter-engaging device comprises a heating element which causes adjacent ones of said outer fibers to fuse.

3. The arrangement of claim 2 wherein said heating element comprises a heating roll having raised fiber engaging lines arranged in a pattern over its outer surface.

4. The arrangement of claim 3 wherein said heating roll comprises a pair of opposed heating rolls adjacent said exit.

5. The arrangement of claim 1 wherein said fiber inter-engaging device comprises at least a portion of said first and second walls.

6. The arrangement of claim 1 wherein said fiber inter-engaging device comprises a needle bed.

7. The arrangement of claim 6 wherein said needle bed comprises opposed needle beds which operate within said fiber web chute.

8. The arrangement of claim 6 wherein said needle bed is carried by at least one of said first and second walls.

9. The arrangement of claim 1 including an air distribution system delivering an air flow into said fiber web forming chute for assisting in the distribution and movement of said fibers within said fiber web forming chute.

10. The arrangement of claim 9 including a distributor associated with said air distribution system, said distributor being operative to add chemicals to said air flow for interacting with said fibers during formation of said fiber web.

11. The arrangement of claim 1, wherein said arrangement includes a conveyor system adjacent said exit, said fiber inter-engaging device being arranged beyond said exit adjacent at least one end of said conveyor system.

12. The arrangement of claim 11 wherein said fiber inter-engaging device comprises a heating member which acts to heat at least said fibers forming said upper and lower outer surfaces of said fiber web causing said heated forming fibers to fuse.

13. The arrangement of claim 12 wherein said heating member comprises a pair of heating rolls.

14. The arrangement of claim 1 wherein said fiber contacting elements include a packing belt forming at least a part of one of said first and second walls.

15. The arrangement of claim 1 wherein said fiber contacting elements include a vibrating plate forming at least a part of one of said first and second walls.

16. The arrangement of claim 1 wherein said fiber inter-engaging device includes a heated compression roll adjacent said exit, said heated compression roll causing said outer fibers to fuse.

17. A method of forming a fiber web including:

providing a supply of opened fibers;

delivering said fibers into a fiber web-forming chute and moving said fibers through said fiber web forming chute forming said fibers into a fiber web;

assisting movement of said fibers in said fiber web forming chute to be compressed forming said fiber web;

providing fiber engaging members and causing said engaging members to assist movement of said formed fiber web along a path to include movement through an exit of said fiber web forming chute onto a conveyor for moving said fiber web to further processing;

providing a fiber inter-engagement device along said path and causing said fiber inter-engagement device to engage with fibers forming outer extremities of said fiber web and causing said outer extremity forming fibers to inter-engage to a degree greater than the remainder of said web-forming fibers creating a fiber web having at least one stabilized outer fiber web extremity.

18. The method of claim 17 including providing said fiber inter-engaging device comprises a needle bed operating within said chute.

19. The method of claim 17 including providing said fiber inter-engaging device comprises a heating member arranged adjacent said exit.

20. The method of claim 19 including providing that the heating member is a heating roll.

* * * * *